United States Patent [19]

D'Angelo et al.

[11] 4,207,667

[45] Jun. 17, 1980

[54] METHOD AND APPARATUS FOR AUTOMATIC SHEET CUTTING AND STACKING

[75] Inventors: Joseph J. D'Angelo, Wycoff; Lawrence Maccherone, Ringwood, both of N.J.

[73] Assignee: Flexible Design Packaging Machine Company, Hawthorne, N.J.

[21] Appl. No.: 946,520

[22] Filed: Sep. 28, 1978

Related U.S. Application Data

[63] Continuation of Ser. No. 832,192, Sep. 12, 1977, abandoned.

[51] Int. Cl.[2] ..... B26D 9/00

[52] U.S. Cl. ..... 29/417; 29/564.6; 82/47; 82/80; 82/101; 83/23; 83/47; 83/91; 83/95; 83/208; 83/262; 83/408; 83/649

[58] Field of Search ..... 83/23, 47, 90, 91, 95, 83/208, 212.1, 262, 408, 649; 29/417, 564.6; 82/80, 101, 47

[56] References Cited

U.S. PATENT DOCUMENTS

| | | | |
|---|---|---|---|
| 1,765,270 | 6/1930 | Hensley et al. | 83/95 X |
| 3,101,638 | 8/1963 | Rhicard et al. | 83/95 |
| 3,555,977 | 1/1971 | Saumsiegle | 83/95 X |

FOREIGN PATENT DOCUMENTS

| | | | |
|---|---|---|---|
| 11138 | of 1912 | United Kingdom | 83/95 |

*Primary Examiner*—Frank T. Yost

*Attorney, Agent, or Firm*—Parmelee, Johnson, Bollinger & Bramblett

[57] ABSTRACT

A method and apparatus are disclosed for forming a stack of neatly aligned sheets of microfoam plastic material from a web of microfoam material. The method and apparatus provide for supplying the web of material to a cutting station and transporting an edge of the material a predetermined distance beyond the cutting station, restraining motion of the web and captivating it at a location adjacent to the cutting station, and cutting the web in a transverse direction. The web advancement, restraint and captivation, and cutting are repeated until a predetermined number of sheets of the material have been accumulated in a stack. The stack is then released from captivation and is conveyed from the cutting station.

32 Claims, 14 Drawing Figures

FIG. 12
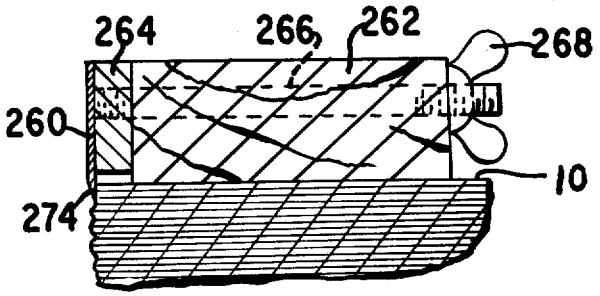
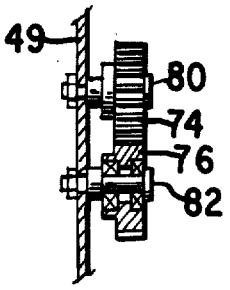
FIG. 13
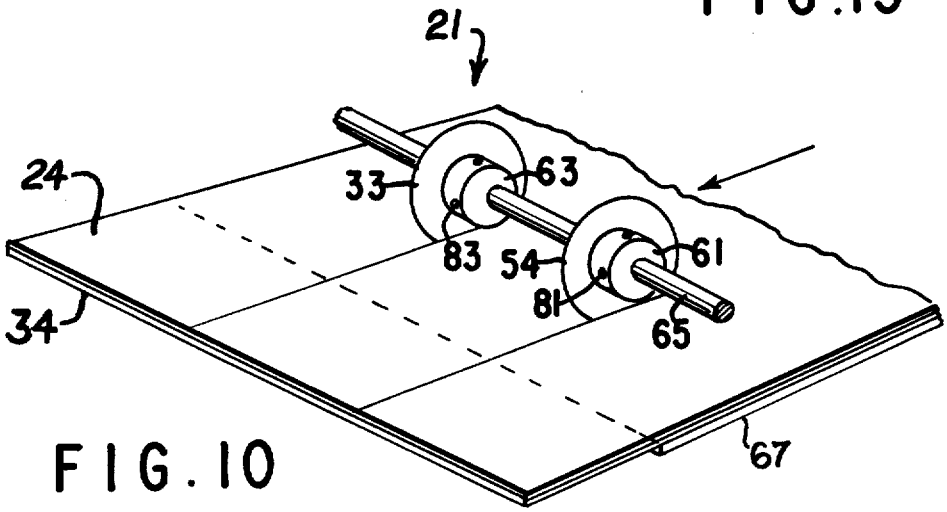
FIG. 10
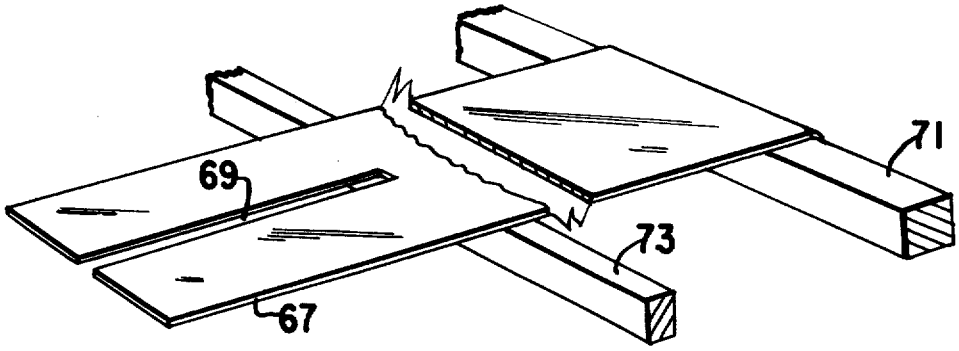
FIG. 11

METHOD AND APPARATUS FOR AUTOMATIC SHEET CUTTING AND STACKING

RELATED APPLICATION

This application is a continuation of prior copending application Ser. No. 832,192, filed on Sept. 12, 1977, now abandoned, from which priority is being claimed.

BACKGROUND OF THE INVENTION

This invention relates to an improved method and apparatus for forming a stack of sheet material from a web of the material. The invention relates more particularly to an improved method and apparatus for providing a stack of aligned sheets from a web of microfoam plastic material.

Microfoam plastic sheet material is used in various businesses and industries for such applications as packaging and upholstering. While microfoam material is initially produced by forming elongated webs which are wound into rolls of relatively large diameter, it is desirable in its application and use to provide the microfoam material in sheet configuration. It is preferable to form sheets from the web by cutting the sheets to desired lengths and to accumulate a predetermined number of cut sheets in alignment in a relatively neat stack or pile for packaging and shipment. Microfoam plastic, however, is a relatively soft, cellular material which is relatively spongey or resilient and because of this characteristic it does not readily lend itself to the desired cutting and neat stacking of sheets.

Accordingly, it is an object of this invention to provide an improved method and apparatus for forming relatively neat stacks of aligned sheets of microfoam material from a web of the material.

Another object of the invention is to provide an improved method and apparatus for simultaneously forming a plurality of stacks and sheets of microfoam material from a single web.

Another object of the invention is to provide an improved method and apparatus for forming a stack of sheets of microfoam material simultaneously from two webs of the material.

SUMMARY OF THE INVENTION

In accordance with features of the present invention, an improved method for forming a stack of sheets of foam plastic material from a web comprises the steps of supplying a web of foam plastic material from a supply roll to a cutting station and transporting an edge of the web for a predetermined distance (L) beyond the cutting station above a sheet receiving surface; restraining longitudinal movement of the web and captivating the web adjacent the cutting station; and cutting the web to provide a captivated sheet of predetermined length (L). The conveying, restraining and captivating, and cutting steps are repeated until a predetermined number of captivated sheets have been accumulated. Captivation of the stack of accumulated sheets is then released and the stack is conveyed to another station for further processing of the stack.

In accordance with other features of the method of the invention, the web is longitudinally restrained by clamping the web at a station before the cutting station and is captivated by penetrating the web with a penetrating means at a location adjacent to and past the cutting station. In accordance with more particular features of the method of the invention, web penetration is provided by forcing the web into penetrating contact with a plurality of penetrating pins.

An apparatus in accordance with features of the invention comprises a web cutting means positioned at a cutting station; means for supplying a web of microfoam plastic material to the cutting station and for conveying an edge thereof a predetermined distance (L) past the cutting station; means for restraining longitudinal movement of the web at a location before the cutting station and for captivating the web at a location past and adjacent to the cutting station; means for receiving a cut sheet of captivated material; control means for causing the release of the longitudinal restraint and for repeatedly supplying, cutting and captivating sheets in order to accumulate a predetermined number of sheets in an aligned, captivated stack; means for releasing said captivated stack; and means for conveying the released stack to a successive processing station.

In accordance with other features of the apparatus of this invention, a means for captivating the web comprises a web penetrating means and means for forcing the web into engagement with said penetrating means for causing captivating penetration of said web. In a more particular arrangement the penetrating means is stationary during penetration and the forcing means causes movement of the web into captivating engagement with the stationary penetrating means.

BRIEF DESCRIPTION OF THE DRAWINGS

These and other objects and features of the invention will become apparent with reference to the following specification and to the drawings wherein:

FIG. 10 is a fragmentary perspective view of a segment of the apparatus of FIG. 1 illustrating the longitudinal cutting of a web of relatively wider width into a plurality of webs of relatively smaller widths;

FIG. 11 is a fragmentary perspective view of a web cutting table of the apparatus of FIG. 10 for longitudinal cutting of a web;

FIG. 12 is an enlarged fragmentary sectional view of an edge trimming means taken along the lines 12—12 of FIG. 2;

FIG. 13 is an enlarged fragmentary view taken along lines 13—13 of FIG. 6 illustrating idler gear means; and, FIG. 14 is a schematic diagram of a control means used with the apparatus of FIG. 1.

DETAILED DESCRIPTION

Figure 1:
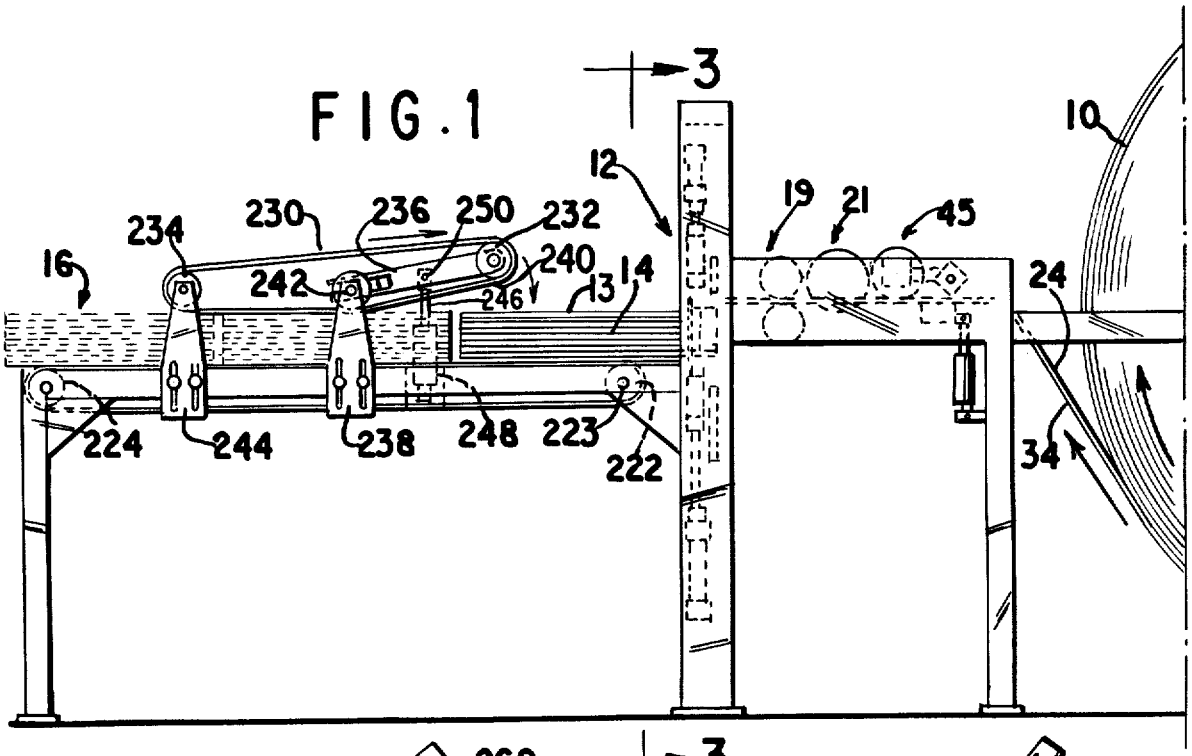
FIG. 1 is a side elevation view of an apparatus constructed in accordance with features of this invention.
Figure 2:
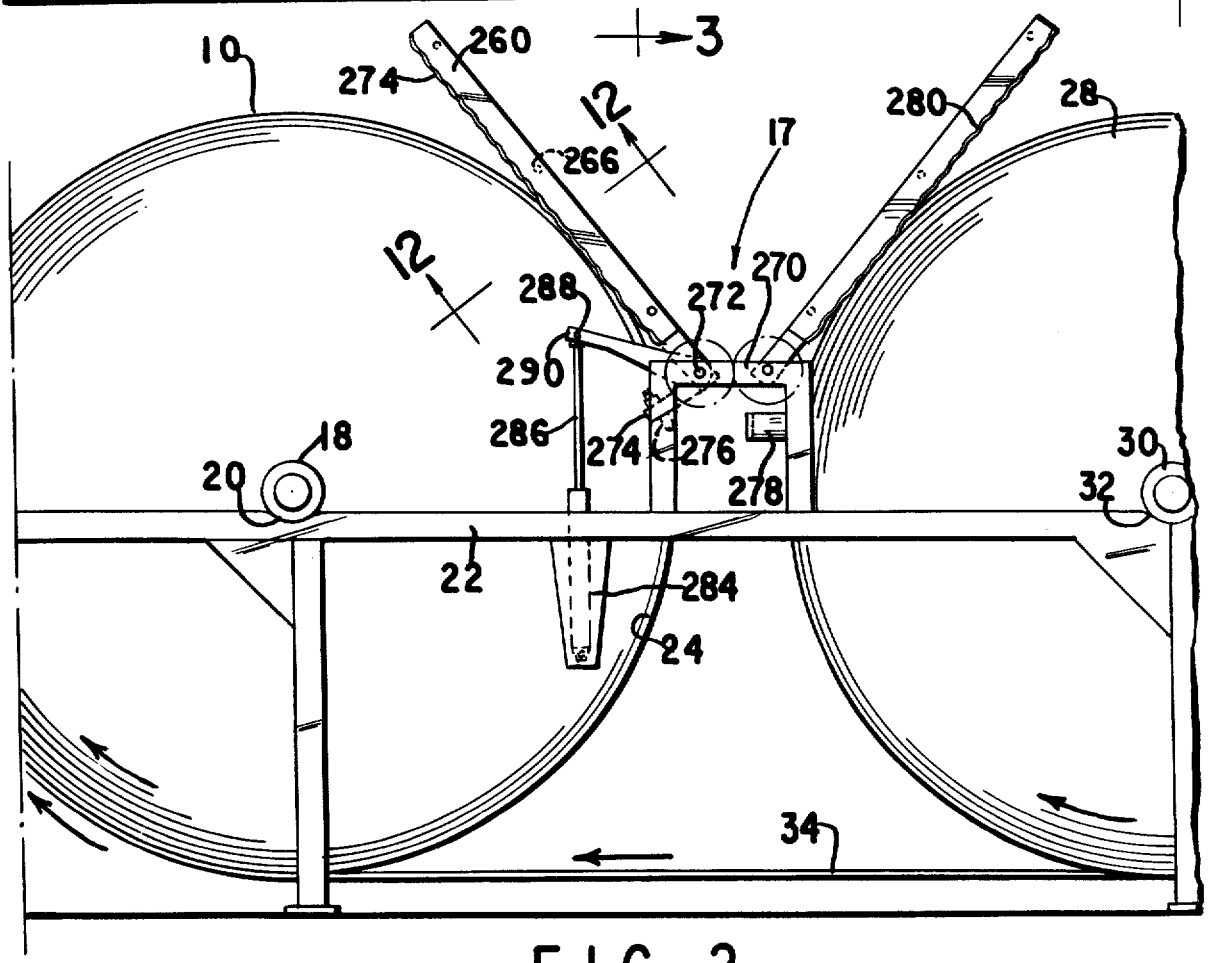
FIG. 2 is a fragmentary, side elevation view of web supply reels for supplying microfoam plastic material in web form to the apparatus of FIG. 1.

Referring now to the drawings and in particular to FIGS. 1 and 2, there is illustrated a means for supplying a web of microfoam plastic material from a reel 10 to a cutting station 12 at which location the web is cut in a transverse direction to provide a sheet 13 of material. This web feeding and cutting procedure is repeated and a plurality of sheets 13 are automatically accumulated in a stack 14 of vertically aligned sheets. As indicated in detail, hereinafter, longitudinal motion of the web is restrained and the web is captivated at a location adjacent to the cutting station in order to facilitate cutting and stacking of the sheets. After a predetermined number of the sheets have been cut and stacked, the stack is then automatically transported to a successive station 16 for further processing, as for example, binding and packaging for shipment.

A means for supplying a web of microfoam material to the cutting station and for conveying an edge of the web a predetermined distance (L) beyond the cutting station comprises a web supply means 17 (FIG. 2) and a web advancing means 19 (FIG. 1) The web supply means 17 comprises the reel 10 and means for rotatably supporting the reel. Reel 10 is a relatively large diameter roll of microfoam plastic material having a diameter of about 4 to 5 feet and which is wound about a support tube or form 18. The microfoam material has a thickness of about 1/16 inch to ¼ inch although other thicknesses can equally well be provided. The tube 18 is cradled on a bearing surface 20 and is supported by a structural frame 22. A first web 24 which has a width of about 7 feet for example, is unwound and is drawn from the reel 10 by the web advancing means 19. During its longitudinal advance toward the cutting station 12, the web 24 is cut in a longitudinal direction by a cutting means 21 (FIG. 1). The longitudinal cutting means 21 is described in detail hereinafter.

The apparatus of FIG. 1 is adapted to cut and stack single and double layered webs. The web supply means 17 is adapted to supply single or double layered webs. When supplying double layered webs, the web supply means 17 further includes a second reel 28 of microfoam plastic material which is wound on a tubular support 30 and is cradled in a bearing surface 32 on the support frame 22. The reels 10 and 28 are spaced along the frame 22 for providing that a second web 34 which is unwound from the reel 28 overlaps the web 24 and is drawn simultaneously therewith from its reel. These webs are simultaneously conveyed in juxtaposed relationship through the cutting station 12.

Figures 4, 5:
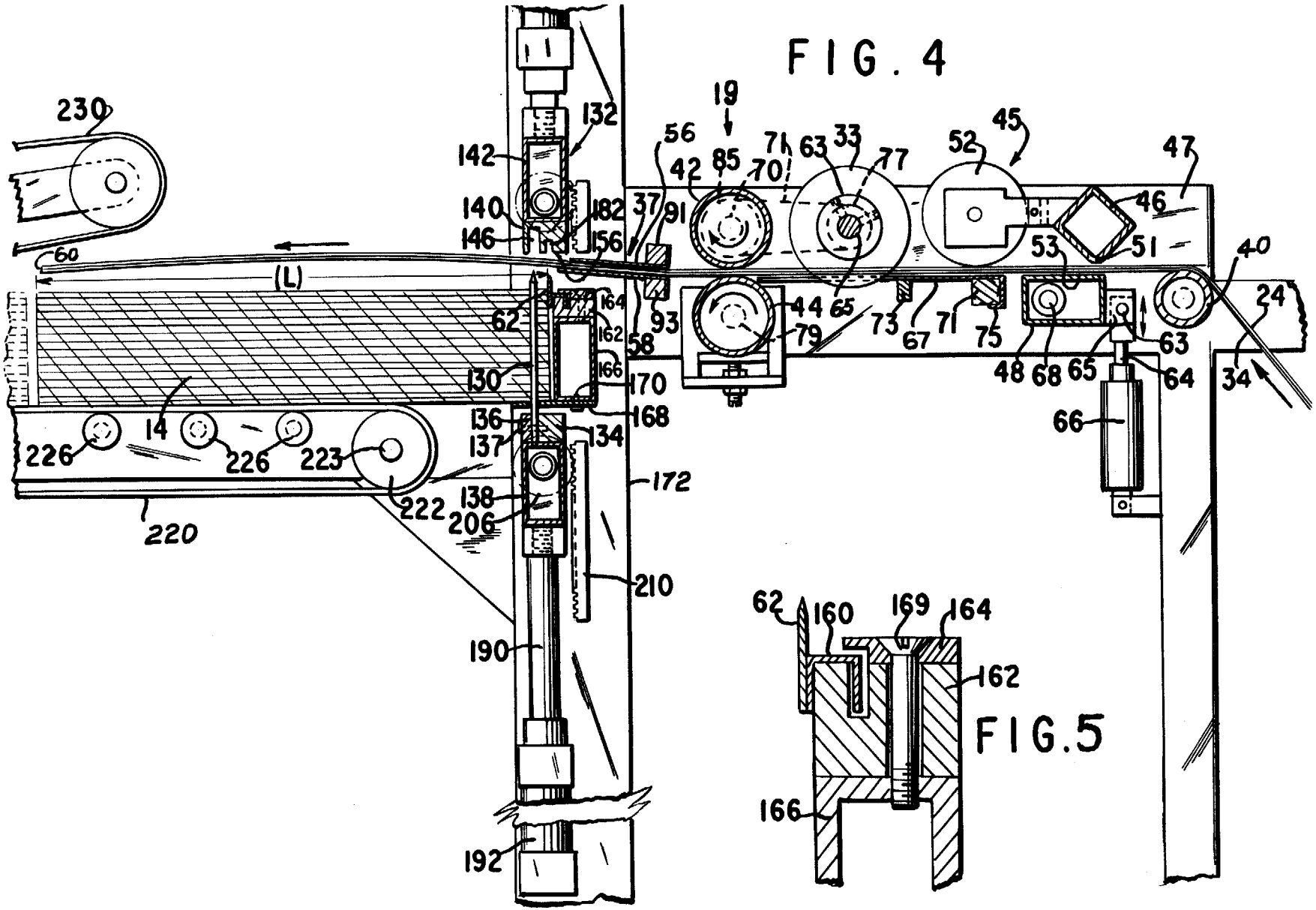
FIG. 4 is an enlarged fragmentary view, partly broken away and taken along lines 4—4 of FIG. 3 which illustrates a web supply and transport step of the method of the invention.
FIG. 5 is an enlarged, fragmentary, cross-sectional view of a cutter means of the apparatus of FIG. 4.
Figure 14:
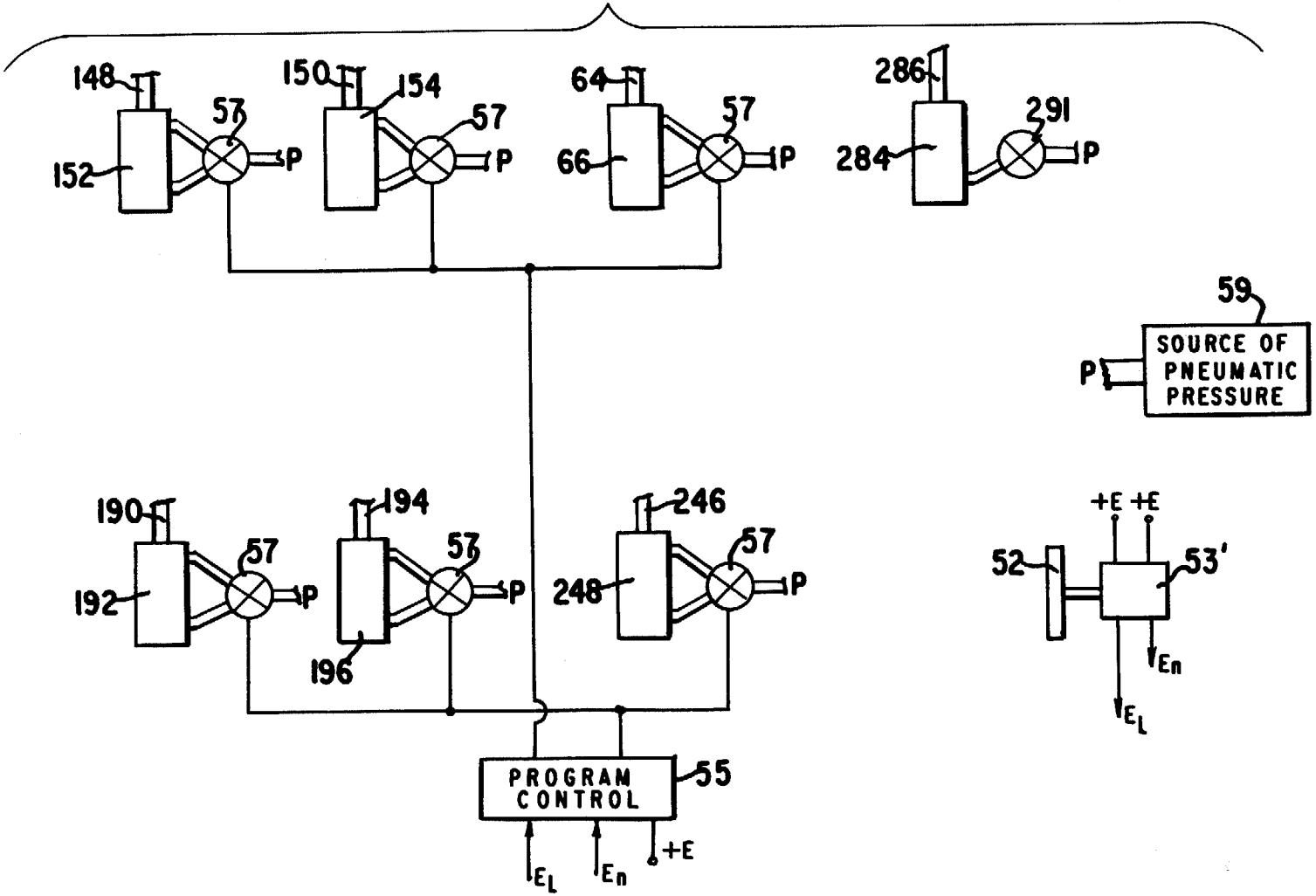

As illustrated in FIG. 4, the web advancing means 19 provides for advancing the web by unwinding it from a reel and advancing it toward and beyond the cutting station 12 by a distance (L). The web advancing means comprises an idler roller 40, pinch rollers 42 and 44, web length measuring means 45 and web elevating means 37. A web is drawn from its reel over roller 40 by rotary motion of the pinch rollers 42 and 44. The direction of rotation of these rollers is represented by arrows in FIG. 4. A web is then conveyed between elevator plates 56 and 58 which introduce a vertical component to the web motion and direct a leading edge 60 of the web past a cutting knife 62 at the cutting station 12 for a predetermined distance (L). Longitudinal movement of the web past a wheel 52 of the measuring means 45 causes rotary motion of this wheel and this motion is coupled to a conventional switch and counter means 53' (FIG. 14). A switch is preset for energization when an angular rotation of the wheel 52 equivalent to a linear web motion of length (L) occurs. An output signal $E_L$ is provided and is coupled to a program control 55 (FIG. 14) for initiating restraint and captivation and transverse cutting of the web. Program control 55 comprises for example, a conventional rotary control switch having switch contacts which energize solenoid actuated pneumatic valves 57 for controlling the sequence of operation of the apparatus. The valves 57 are actuated for applying pneumatic pressure (P) from a source 59 to various cylinders for causing extension or retraction of associated pistons as described in detail hereinafter. Counter 53 also provides an output signal $E_n$ when a predetermined number (N) of counts representing cut and stacked sheets has been attained. This signal is applied to the program control 55, initiating release of stack captivation and transfer of the stack to a successive station. These operations are described more fully hereinafter.

Figure 6:
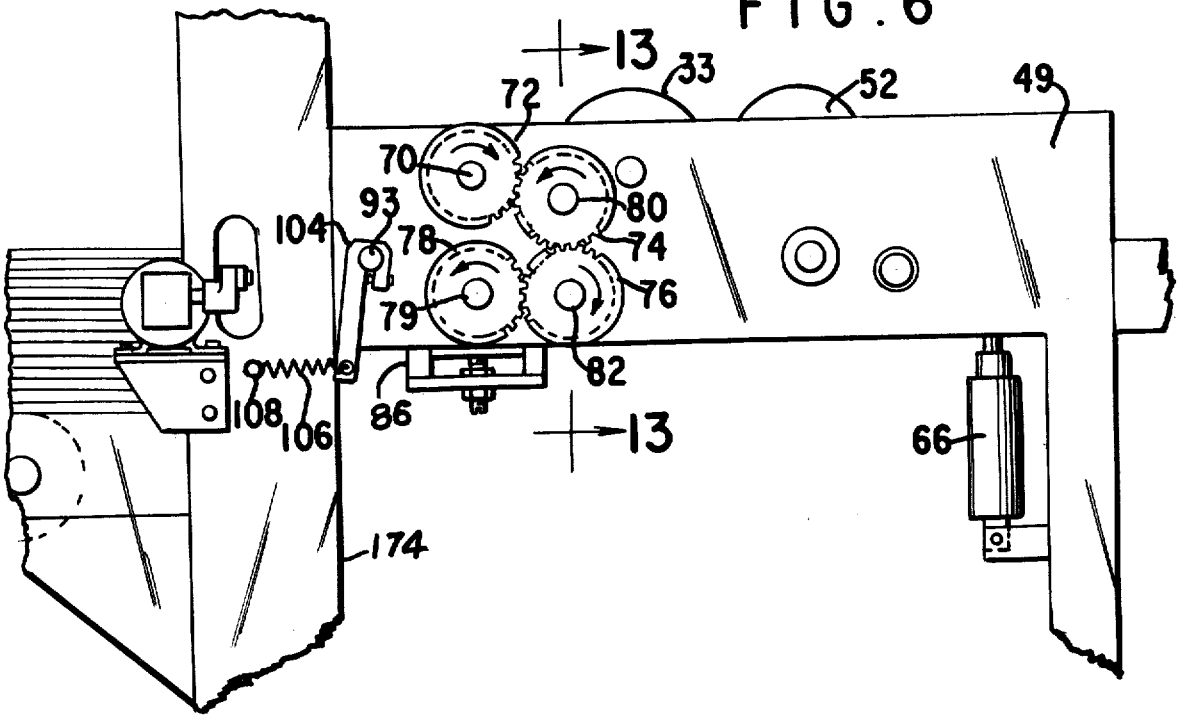
FIG. 6 is an enlarged, fragmentary, side elevation view of the apparatus of FIG. 1.

A means is provided for varying the spacing between the pinch rollers in order to accommodate various thicknesses of single or double layered webs. The pinch roller 42 is mounted on a drive shaft 70 for rotation therewith. As shown in FIG. 6 rotary motion which is imparted to the roller 42 by the shaft 70 is coupled to the opposite pinch roller 44 through a gear 72 also mounted on the shaft 70, by an idler gear 74 and an idler gear 76 and by a gear 78 which is mounted on a shaft 79 with the pinch roller 44. The gears 74 and 76 are rotatably mounted on stationary shafts or bearings 80 and 82 respectively. The spacing between the pinch rollers 42 and 44 is made adjustable by a bearing block 84 (FIG. 7) which is mounted in a housing 86. The housing 86 includes grooved inner walls 88 and 90 for guiding and constraining movement of a bearing block plate 92. A spacer screw 94 extends through a threaded aperture 97 in a lower member 96 of the housing 86. By rotating screw 94, the vertical position of the plate 92 can be adjusted. Lock nuts 95 and 98 are provided for securing the screw 94 in a desired position. The shaft 79 for pinch roller 44 is supported on a bearing surface 99 of the bearing block 84. Springs 101 and 102 resiliently support and space the bearing block on the plate 92. Positional variations between shafts 70 and 79 are provided by rotational adjustment of screw 94. Spacing between the pinch rollers 42 and 44 is thereby accomplished by this adjustment. This movement is advantageously accomplished over a limited range without binding of the gears.

Figure 7:
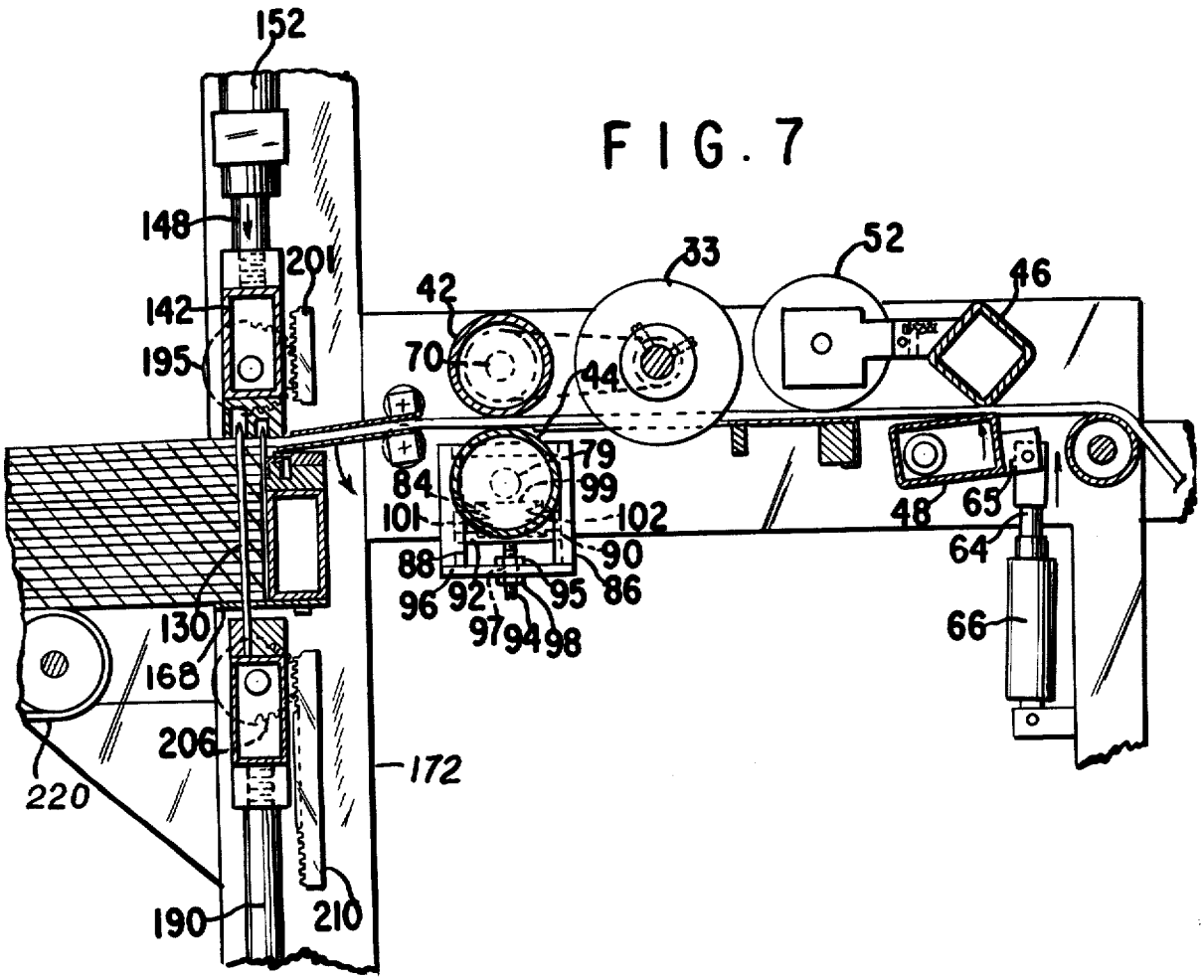
FIG. 7 is another view of the apparatus of FIG. 4 illustrating a web cutting step in accordance with the method of this invention.

A means for restraining longitudinal movement of the web at a location before the cutting station is provided and comprises a tubular, rectangular shaped, stationary anvil 46 (FIG. 4) which is mounted between side frame members 47 and 49 (FIG. 6) of the apparatus. The expression "before" the cutting station for the purposes of this specification and the appended claims is understood to mean upstream in the direction of web movement from the cutting station. Similarly, the expression "past" the cutting station is understood to mean downsteam in the direction of web movement from the cutting station. The anvil 46 extends across the width of the moving web and a corner segment 51 thereof is positioned adjacent the web surface. A tubular, rectangular shaped web clamping member 48 is also provided and is pivotally mounted on a shaft 68 which is journaled between the frame members 47 and 49. The clamp member 48 is positioned for providing that an upper surface 53 thereof is positioned adjacent the web and is spaced from the corner segment 51 of the anvil 46 by an amount for permitting unrestricted longitudinal movement of a web or webs past this member and past the anvil. The clamp member 48 includes an extending arm segment 65 which is coupled to a piston 64 of a cylinder 66 by a wrist pin 63. The piston 64, as illustrated in FIG. 4, is shown in a retracted position and establishes a spacing between the member 48 and the corner 51 of the anvil 46 thereby permitting movement of the web past this restraining station. When the piston 64 is extended as illustrated in FIG. 7, the member 48 is rotated in a counterclockwise direction thereby engaging the web and, compressing it against the anvil segment 51 to restrain the longitudinal motion of the web. The source of pneumatic pressure 59 (FIG. 14) is coupled to the cylinder 66 for causing extension and retraction of the piston in response to the program control 55.

As the web is drawn by the pinch rollers 42 and 44 past the restraining and counting means, the relatively wide web is cut in a longitudinal direction into a plurality of webs of relatively smaller width. The longitudinal cutting means is illustrated in FIGS. 4, 10 and 11. The cutting means comprises one or more cutting wheels 54 and 33 each having hubs 61 and 63 respectively which are positioned on and secured for rotation with a shaft 65. The shaft 65 is supported on bearings in the frame side members 47 and 49. The web which is being cut longitudinally passes over a cutter table 67 (FIG. 11) having a slot 69 formed therein and into which depends a segment of a cutter wheel. One such table is provided for each cutter wheel. The table 67 is supported on block members 73 and 71 which extend between the frame members 47 and 49. The cutting table 67 includes lip 75 (FIG. 4) extending about the block 71 and the table is secured in place by conventional clamping means not illustrated. Desired dimensions of the width of the relatively smaller webs which are cut by the wheels 54 and 33 are established by positioning the cutter wheels at the desired location on the shaft 65 and by repositioning the table 67 so that the slot 69 is in alignment with the associated cutter wheel. The repositioning of the wheels 54 and 33 is accomplished by loosening set screws 81 and 83 in the hubs 61 and 63 respectively, and retightening the same when the wheels are properly positioned. Similarly, the tables 67 are positioned to coincide with the depending wheels by releasing associated clamps and retightening them at the established table position. Rotary motion is imparted to the cutter wheels by a drive belt 71 which is coupled between a pulley 85 on pinch roll shaft 70 and a pulley 77 (FIG. 4) which is mounted on the shaft 65.

As indicated hereinbefore, a forward or leading edge 60 of the web is transported past the knife 62 at the cutting station 12 by a predetermined distance (L). Because of the flexure of the web material over its length and the need to provide clearance between the traveling web and objects at the cutting station as well as to provide clearance between the traveling web and an accumulated stack of cut sheets, the elevator means 37 is provided in order to impart to the traveling web a vertical deflection enabling the leading edge 60 to clear the objects and the accumulated stack of cut sheets.

The elevator means 37 comprises a pair of plates 56 and 58 which form a guide for the traveling web. The plate 56 is supported on a shaft 91 which is mounted between the frame members 47 and 49. The plate 58 is secured to a rotable shaft 93 which is journaled between the frame members 47 and 49. The shaft 93 extends through the frame member 49 and a lever arm 104 (FIG. 6) is coupled thereto. A resiliant means comprising a spring 106 is secured to a post 108 and to an aperture of lever arm 104 for biasing the lever arm and causing the shaft 93 and thus the plate 58 to be positioned with respect to the plate 56 for guiding the web in an upwardly direction. As indicated hereinafter during cutting of the web, the web and plate 58 are forced in a downwardly direction thereby causing counterclockwise rotation of the plate 58 and of the lever arm 104 against the restraining force of the spring 106. The plate 58 is subsequently released and the spring 106 restores the plate to its upward attitude.

A means for captivating the web adjacent the cutting station 12 comprises a transversely aligned array of stacking pins 130 (FIG. 3) supported at a location adjacent to and past the cutting station and a means for forcing the web into engagement with the stacking pins. This latter means is represented generally by reference numeral 132, as shown in FIG. 4. The stacker pins 130 are secured in bores formed between stacker pin block members 134 and 136. The member 136 is secured to the block 134 by a plurality of screws 137 extending across the width of these members. The mounting block 134 is positioned on and secured to a tubular, rectangular shaped support channel 138 which supports the stacker pins 130 at a predetermined vertical location during cutting and accumulating of sheets 13.

A means for forcing the web into engagement with the stacker pins 130 comprises a block 140 which is secured to and depends from a tubular, rectangular shaped support channel 142. The block 140 includes a groove 146 formed therein which is positioned in alignment with the array of stacker pins 130. Vertical motion is imparted to this block by pistons 148 and 150 (FIG. 3) which extend from cylinders 152 and 154 respectively and causes the channel 142 to descend and establish engagement between the array of stack pins 130 and the groove 146. During this descent, a lower surface 156 of the block 140 (FIG. 4) contacts the web and forces it into engagement with the stacker pins, as shown in FIG. 7. Because of the cellular and resilient characteristic of the microfoam web material, the pins readily penetrate the web without causing damage to the web and provide captivation of the web in a longitudinal direction adjacent and past the cutting station 12. During the descent of the block 140, a segment of the lower surface 156 contacts a web portion at the plate 58 and causes counter clockwise rotation of this plate as shown by the arrow in FIG. 7 until the plate 58 contacts a stop provided by a surface of guide block clamp 164 described hereinafter. The web is therefore captivated at a location adjacent to and past the cutting station and is simultaneously restrained at a location preceding the cutting station. The web thus restrained and captivated is conditioned for cutting at the cutting station.

Figure 3:
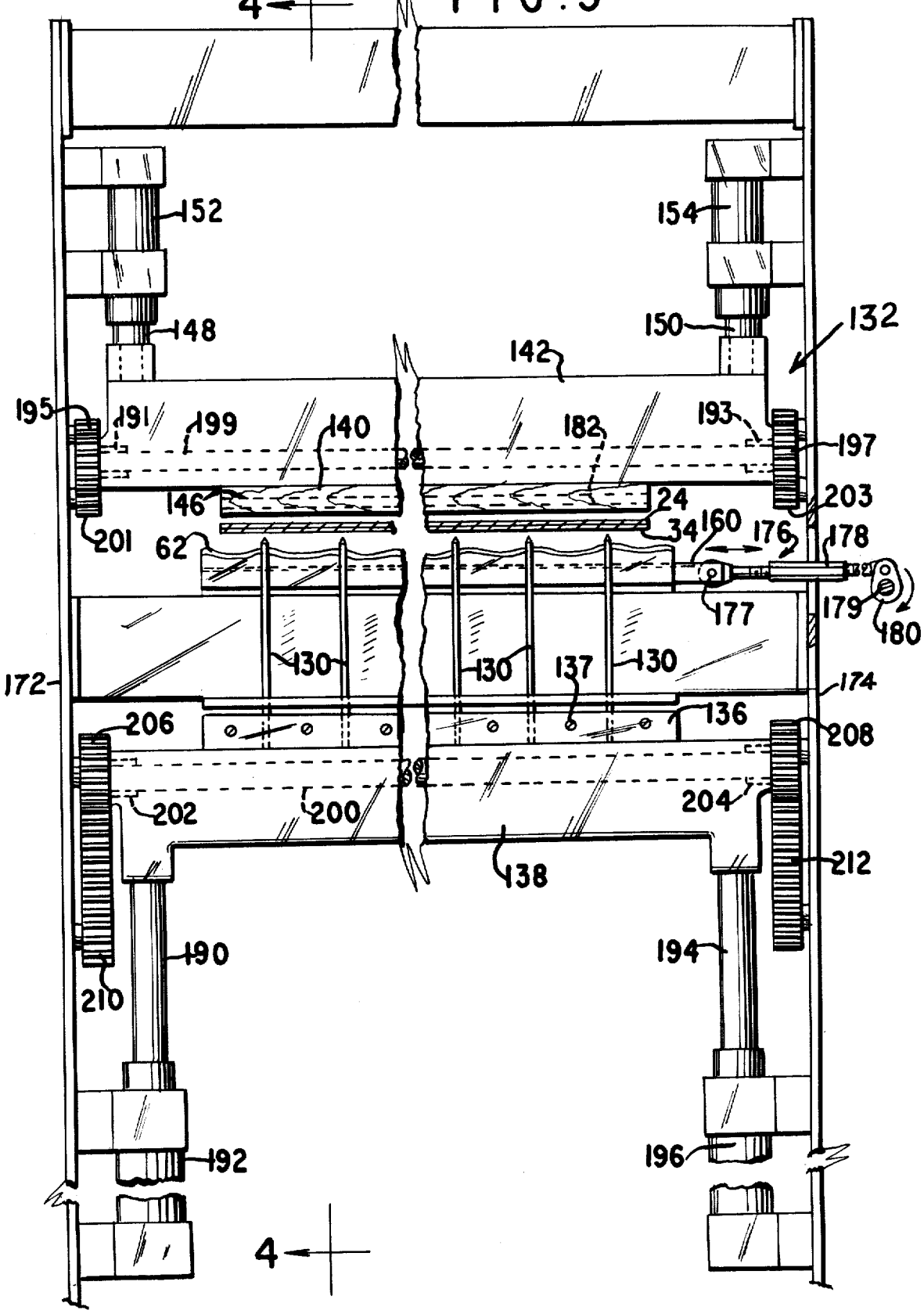
FIG. 3 is an enlarged, fragmentary view, partly broken away taken along lines 3—3 of FIG. 1.

A means for cutting a web in a transverse direction comprises, as illustrated in FIGS. 3, 4 and 5, the cutter knife 62, a channel shaped knife support 160 to which the knife 62 is mounted by welding, screws, or other conventional means, a guide block 162, a guide block clamp 164, a tubular, rectangular shaped channel 166, screw means 169 for securing the block to the channel 166 and a support plate 168 (FIG. 4). The channel 166 is mounted on plate 168 and secured thereto by screw means 170. Channel 166 is mounted to frame members 172 and 174 of the apparatus. The cutter blade 62 has a serrated surface as illustrated in FIG. 3 and is reciprocated, in a transverse direction relative to the direction of web motion, by a drive shaft 179. The drive, which is coupled to the knife support channel 160 by a wrist pin 177, includes an adjustable length connecting rod 178. The connecting rod 178 is coupled to a rotary drive shaft 179 by an arm 180. The rotary drive shaft 179 is driven with an oscillating rotary motion for causing reciprocating linear motion of the cutter blade 62.

The block 140 (FIG. 4) includes a second groove 182 which extends co-extensively with the cutter blade and which engages the cutter blade when the block 140 descends. Thus, as the block 140 forces the web into engagement with the stacking pins, the cutter blade will reciprocate and cut the web in a transverse direction to provide a cut sheet of material. The sheet thus cut will, depending upon its porosity, slide down the stacker pins to a receiving surface provided by frame 168 and a conveyor belt 220 or alternatively it will become impaled on the pins 130. In the latter case, the web will be forced further down onto the pins 130 by sheets which are subsequently cut and forced into engagement with the pins.

After each cutting step, the block 140 is raised to a retracted position thereby enabling the successive feed of the web past the cutting station. The web feeding, restraining and captivating, and shearing steps are repeated until a stack of sheets of predetermined number (N) is accumulated as illustrated in FIG. 4.

Figure 8:
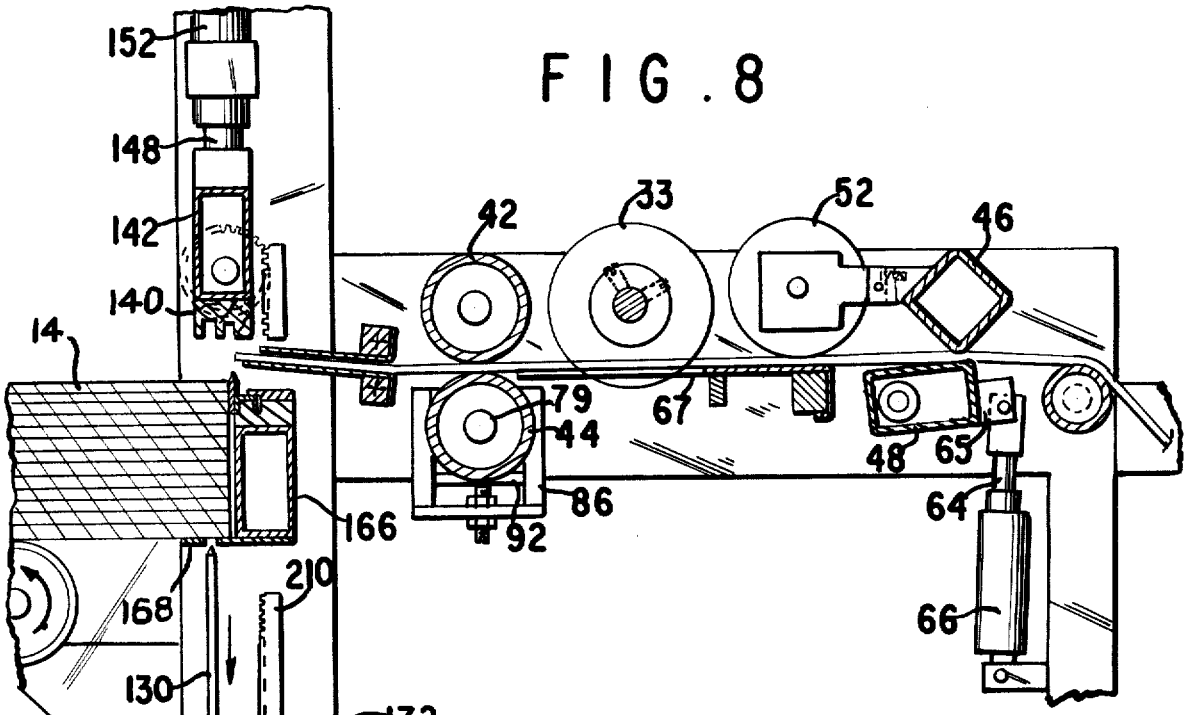
FIG. 8 is another view of the apparatus of FIG. 4 illustrating a stack-captivation-release step in accordance with the method of this invention.
Figure 9:
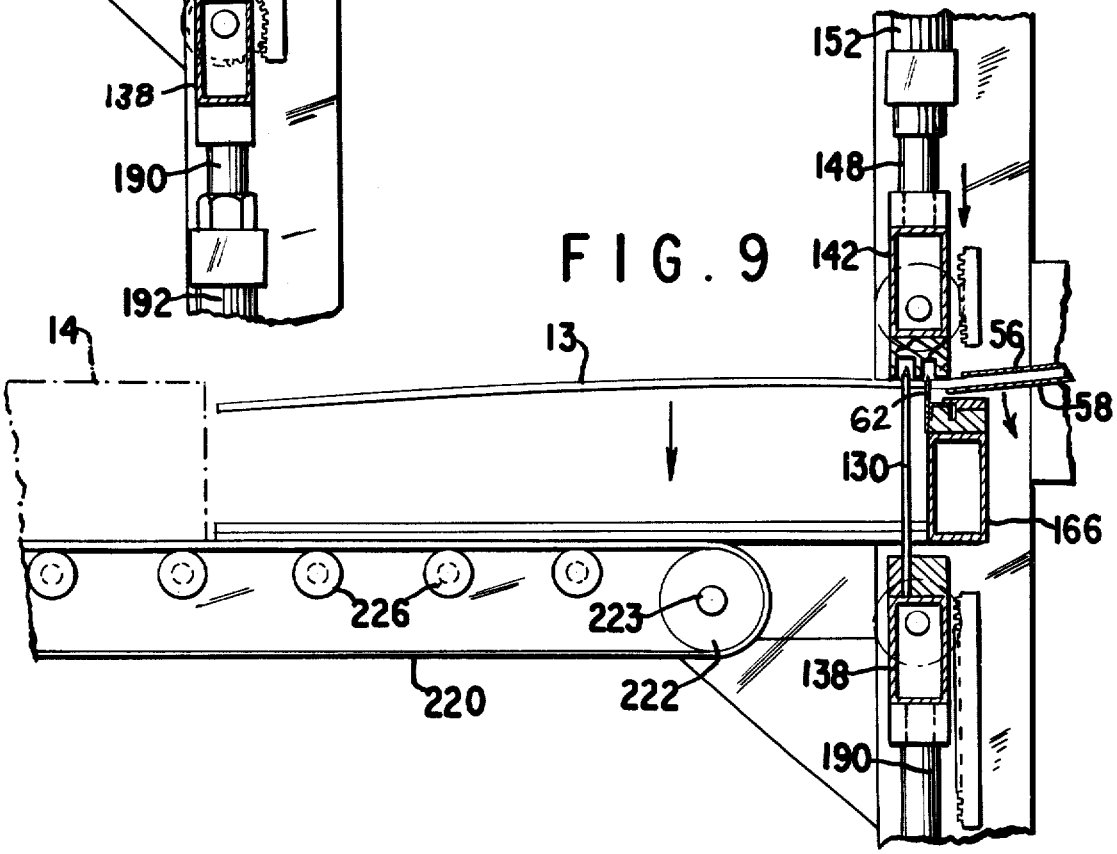
FIG. 9 is an enlarged fragmentary view of a part of the apparatus of FIG. 1 illustrating a web cutting step in accordance with the method of this invention.

A means is provided for releasing the captivated stack of sheets. This means comprises as piston 190 (FIG. 3) and cylinder 192, a piston 194 and a cylinder 196. The pistons 190 and 194 each support the rectangular shaped channel member 138. When a predetermined number (N) of sheets have been accumulated in the stack, the program control means 55 (FIG. 14). causes the retraction of the pistons 190 and 194 into their cylinders 192 and 196 respectively. During this retraction, as shown in FIG. 8, the channel support 138 is lowered and the stack of pins 130 mounted thereon are simultaneously withdrawn from the stack of sheets thereby releasing captivation of the sheets.

It is desirable that the rectangular shaped channels 142 and 138 progress uniformly in their vertical motion and do not exhibit a variation in elevation across the width of the web. Accordingly, the motion of each of these channels under the force of their two pistons is controlled by rack and pinion means and torque tubes. As illustrated in FIGS. 3 and 4, a torque bar 199 extends through hubs 191 and 193 in the end segments of the channel and engages pinion gears 195 and 197. Pinion gears 195 and 197 engage rack 201 and 203 respectively which are mounted to the frame members 172 and 174 respectively. Similarly, a torque tube 200 extends through hubs 202 and 204 of the channel 138 and is secured to pinion gear 206 at one end and pinion gear 208 at an opposite end of the channel. The gears 206 and 208 engage rack gears 210 and 212 respectively which are mounted to the side frame members 172 and 174 respectively. As the pistons 148 and 150 and the pistons 190 and 194 cause motion of the associated channels, the torque tubes and rack and pinion gears cause uniform motion at each end of the channels.

Referring now to FIGS. 1 and 4, the stack of accumulated sheets are received by and supported on a surface of a conveyor belt 220 and the support plate 168. Upon movement of the stacking pins 130 and the block 140 to retracted positions, the conveyor belt 220 which has been continuously supporting the captivated stack, operates to transport the stack to a succeeding station 16. The belt 220 extends between a location adjacent the cutting station and the succeeding station 16 and is supported by a drive pulley 222 (FIG. 1) near the cutting station, an idler pulley 224 near the station 16 and a plurality of idler pulleys 226 as indicated in FIG. 4. Motion is imparted to the conveyor belt 220 by the drive pulley 222 which is driven by a shaft 223.

In order to hold down and maintain the sheets in the desired alignment as the stack is transported by the conveyor belt 220, a second conveyor belt 230 (FIG. 1) is provided which is supported above a surface of an upper sheet of the stack. The conveyor belt 230 extends between a belt driven drive pulley 232 and an idler pulley 234. The drive pulley is supported on a longitudinally extending arm 236 which is pivotally mounted on a support bracket 238. The pulley 232 is driven by a belt 240 to which motion is imparted by a drive wheel 242 which is mounted at an upper part of the bracket 238. The drive wheel 242 is rotated by further drive belt means, not illustrated for purposes of simplicity in the drawing. The pulley 234 is similarly supported by a bracket 244. Each of the brackets 238 and 244 can be adjusted vertically in order to accommodate the desired stack height. The belt 230 is brought into engagement with a surface of an upper sheet 13 in the stack 14 by the action of a piston and cylinder assembly comprising a piston 246 and a cylinder 248. The piston 246 is coupled to the arm 236 at pivot 250, and its retracting motion causes the arm 236 which is rotatably mounted at a pivot point near wheel 242, to rotate the belt 230 into engagement with the stack 14. The simultaneous motion of the conveyor belt 220 and the hold-down conveyor belt 230 results in the transfer of the stack of sheets from the cutting station to the successive station without relative horizontal movement between the sheets and results in maintaining alignment during the motion.

The microfoam material which is supplied to the cutting station from the reels 10 and 28 at times exhibit variation in the width of the material as the result of variation in the manufacturing process and the like. A means is provided for supplying a web of uniform width to the cutting station. As illustrated in FIGS. 2 and 12, this means comprises an elongated knife 260 having a serrated edge and which is positioned for trimming the edge of the reel 10. The blade 260 is mounted to a block 262 with a spacer block 264 and a plurality of bolts 266 and wingnuts 268. The block 262 is pivotally mounted to a frame member 270 by a pivot pin 272. The block 262 is positioned on a surface of the web of reel 10 and as the reel is rotated past an edge 274 of the knife, the edge of the web is automatically trimmed to provide a uniform width. A pair of knife blades is provided for each reel. The block 262 includes an extending arm 274 having a bumper member 276 mounted therein for contacting a stop 278 which is mounted on the frame 270. This arrangement inhibits the blade from contacting the tubular roll 18 as the diameter of the reel 10 decreases. When the bumper member 276 contacts the stop 278, the counter clockwise motion of the blade 260 is inhibited. A similar pair of trimmer blades, one of which is shown as blade 280, is provided for trimming the edges of the reel 28.

In order to remove the tube 18 and to replace the reel 10, a piston and cylinder assembly is provided which includes a cylinder 284 and a piston 286. The piston 286 is coupled by a wrist pin 288 to a lever arm 290. The lever arm 290 is coupled to the block 262. The blade 260 is raised to the position indicated by extension of the piston 286 from the cylinder 284. This is accomplished through a hand actuated valve means 291 (FIG. 14) which applies pneumatic pressure to the cylinder 284.

The program control means 55 of FIG. 14 operates to provide the sequence of apparatus events described hereinbefore. It accomplishes this by applying an operating potential (E) to the various solenoid operating valves 57 for causing extension and retraction of the various pistons. AS indicated, the program control means 55 comprises a rotary programmer having a plurality of switch contacts which can be selected to establish the desired valve control timing.

There has thus been described an improved method and apparatus for forming a stack of aligned sheets of microfoam material from a web of the microfoam material. The method and apparatus further provide for restraining and captivating the web, for enhancing the cutting of the web, for maintaining alignment of the accumulated sheets subsequent to cutting, and for simultaneously providing a plurality of such stacks.

While there has been described a particular embodiment of the invention, it will be apparent to those skilled in the art that variations may be made thereto without departing from the spirit of the invention and the scope of the appended claims.

What is claimed is:

1. A method for forming a stack of sheets of foam plastic material and the like from a web thereof comprising the steps of:

A. supplying a web of material to a cutting station and transporting an edge of the web for a predetermined distance (L) beyond the cutting station above a sheet receiving surface;

B. stopping longitudinal movement of the web and captivating the web downstream from and adjacent to the cutting station;

C. cutting the web in a direction generally transverse to the direction of longitudinal movement of the web to provide a captivated sheet of predetermined length (L);

D. repeating the conveying, restraining and captivating, and cutting steps until a predetermined number (N) of captivated sheets have been accumulated in a stack; and E. releasing the captivation of the stack of accumulated sheets.

2. The method of claim 1, wherein the web is longitudinally stopped by clamping the web at a station before the cutting station and captivating the web at a location past the cutting station.

3. The method of claim 2, wherein the web is captivated by penetrating the web with a penetrating means at a location adjacent to and downstream from the cutting station.

4. The method of claim 3 wherein the captivation is provided by forcing the web into penetrating contact with a plurality of pins.

5. The method of claim 4 wherein said web is captivated by advancing a body into contact with the web for causing the web to be forced into contact with and to be impaled on a plurality of captivating pins.

6. The method of claim 5, wherein said pins are upstanding and said body includes a web contact surface having clearance adapted for receiving a length of each of said plurality of pins thereby forcing said web into engagement with said pins upon penetration of said pins through said web with said pins being received by said clearance in said body.

7. The method of claim 1, wherein the web has a width of predetermined dimension and including the step of cutting the web longitudinally into a plurality of widths of relatively smaller dimension at a location before the cutting station whereby a plurality of cut sheets are simultaneously produced by said transverse cutting at the cutting station.

8. The method of claim 1 wherein said web material is provided in a roll of microfoam plastic material and is supplied to the cutting station by drawing the web between pinchroll means and unwinding the web of material.

9. The method of claim 1 including the step of automatically trimming the web to a uniform width during unwinding of the web.

10. Apparatus for cutting and stacking a plurality of sheets of microfoam and similar material comprising:

A. a web cutting means positioned at a cutting station for cutting the web transversely to its length;

B. means for supplying the web of the material to be cut to the cutting station and for conveying an end portion of the web a predetermined distance (L) past the cutting station;

C. means for restraining longitudinal movement of the web at a location before the cutting station and for captivating the web at a location past and adjacent to the cutting station;

D. means for supporting a cut sheet of the captivated material;

E. control means for causing the release of the longitudinal restraint and for repeatedly supplying, cutting and captivating sheets in order to accumulate a predetermined number (N) of sheets in an aligned, captivated stack; and F. means for releasing said captivated stack.

11. The apparatus of claim 10, wherein said means for captivating the web comprises a web penetrating means for forcing the web into engagement with said penetrating means for causing captivating penetration of said web before the web is transversely cut by said web cutting means.

12. The apparatus of claim 11 wherein said penetrating means is maintained stationary during penetration and said forcing means causes movement of the web into captivating engagement with the stationary penetrating means.

13. The apparatus of claim 12, wherein said captivating means comprises an array of aligned pins extending in a direction generally normal to the direction of longitudinal movement of the web and said means for forcing the web into engagement with said penetrating means comprises an elongated body having a surface adapted to a contact, said web having means formed therein for providing clearance for the portions of said pins which have penetrated through said web.

14. The apparatus of claim 10, wherein said means for spplying said web to said cutting station comprising a pair of first and second pinch rollers, a drive shaft, said first pinch roller being mounted on said drive shaft, a first gear mounted on said drive shaft for rotation therewith, said second pinch roller being mounted on a second rotatable shaft, a gear mounted on said second shaft for rotation therewith, third and fourth gear means for intercoupling said first and second gears whereby the rotation of said drive shaft causes rotation of said second gear and said second pinch roller, and an adjustable bearing block means for varying the position of said second shaft relative to the position of said drive shaft for adjusting the spacing between said pinch rollers.

15. The apparatus of claim 10, including a knife means positioned upstream from the web cutting means for cutting a web into a plurality of widths of relatively smaller dimension for simultaneously producing a plurality of cut sheets by said web cutting means at said cutting station.

16. The apparatus of claim 10 including means for conveying the released stack from the cutting station comprising a conveyor belt for receiving said stack of sheets and conveyor belt means for engaging an upper part of said stack.

17. The apparatus of claim 10 including elevating means for elevating the web as it is transported through the cutting station.

18. The method of forming a stack of sheets of foam plastic material as claimed in claim 1, wherein said web is a multiple-layered web and including the steps of providing each layer of said multiple-layered web from a different roll of microfoam plastic material, unwinding the plastic material from the respective rolls and bringing the plastic material into juxtaposed relationship for forming said multiple-layered web which is supplied to the cutting station.

19. The method of forming a stack of sheets of foam plastic material as claimed in claim 1, in which the web is captivated downstream from the cutting station by impaling the web on a plurality of pins which are located at respective positions spaced transversely with respect to the web.

20. The method for forming a stack of sheets of foam plastic material as claimed in claim 19, in which the web is impaled upon said pins by positioning said pins in parallel relationship with their points extending upwardly, and forcing the web downwardly into penetrating contact with the pins.

21. The method for forming a stack of sheets of foam plastic material as claimed in claim 20, including the steps of positioning cutting means at the cutting station extending transversely with respect to the web, and continuing to force the web downwardly to come into cutting relationship with said cutting means subsequent to said penetrating contact with the pins, whereby the web is captivated downstream from the cutting station by penetrating contact with the pins before being cut into sheets.

22. The method of claim 1, wherein a plurality of stacks of cut sheets of foam plastic material are formed including the steps of initially supplying a relatively wide web of foam plastic material, cutting said web longitudinally into a plurality of webs of relatively smaller widths upstream from the cutting station, captivating each of said plurality of webs of relatively smaller width at a location downstream from and near to the cutting station by impaling each of said webs on a plurality of pins, and subsequent to said impaling cutting said captivated webs transversely at the cutting station, thereby to hold each of the resultant cut sheets neatly aligned in captivated relationship by being impaled by said pins, whereby a plurality of neat stacks of captivated cut sheets are accumulated by repeating said steps.

23. The method as claimed in claim 22, wherein a plurality of stacks of cut sheets of foam plastic material are formed, in which the neat stacks of cut sheets are all simultaneously released from captivation, and conveying said neat stacks away from the cutting station by simultaneously conveying both the top and bottom of each stack for maintaining alignment of the sheets in each stack during motion away from the cutting station.

24. Improved apparatus for cutting and stacking a plurality of sheets of microfoam material as claimed in claim 10, in which said web cutting means for cutting web transversely is a cutting element extending transversely with respect to the microfoam material, and said means for cativating the microfoam material includes a plurality of pins positioned at points spaced transversely with respect to the width of the material and located downstream from said cutting element, and means for moving said pins relative to the microfoam material for impaling the material on said pins before the material is cut by said cutting element.

25. Improved apparatus for cutting and stacking a plurality of sheets of microfoam material as claimed in claim 24, in which said pins project vertically upwardly and have their points at a higher elevation than said cutting element when the microfoam material is impaled thereon, said means for moving said pins relative to the microfoam material are movable in an upward and a downward stroke, and during the downward stroke pushes material downwardly into impaling relationship with the points of the pins for captivating the material downstream from said cutting element and thereafter pushes the material downwardly against said cutting element.

26. Improved apparatus for cutting and stacking a plurality of sheets of microfoam material as claimed in claim 25, in which said cutting element is a horizontal knife blade mounted for transverse reciprocation, and reciprocating drive means coupled to said knife for moving it back and forth for cutting the microfoam material.

27. Apparatus for automatically cutting a web of flexible material transversely to its length for cutting off the end portion of the web and for stacking the plurality of sheets formed by repeating such cutting comprising:

A. web cutting means positioned at a cutting station for cutting the web transversely to its length;

B. means for feeding a web of the material to be cut through the cutting station with an end portion of the web moving a predetermined distance (L) downstream from the cutting station;

C. means for stopping the feeding of the web when said end portion is at said predetermined distance downstream from the cutting station;

D. captivating means positioned downstream from the cutting station and located closer to the cutting station than said predetermined distance for captivating the end portion of the web;

E. control means for causing said captivating means to captivate the end portion of the web and for causing said cutting means to cut off the end portion of the web after captivation thereof and for causing a repeated sequence of the feeding, stopping, captivating and cutting; and F. means for releasing the resulting cut stack of sheets from captivation.

28. Apparatus as claimed in claim 27, in which:

said captivating means includes a plurality of upright pins having sharpened points and being arranged in a row extending transversely to the direction of feeding of the web and positioned closely adjacent to the cutting station.

29. Apparatus as claimed in claim 28, in which:

said means for feeding the web through the cutting station includes means for conveying the end portion of the web over the sharpened points of said pins.

30. Apparatus as claimed in claim 29, in which:

said captivating means includes means for impaling the web onto said pins prior to the cutting of the web.

31. Apparatus as claimed in claim 30, in which:

said means which impales the web upon said pins thereafter pushes the web against the cutting means.

32. Apparatus as claimed in any one of claims 27, 28, 29, 30 or 31, in which:

longitudinal cutting means are positioned upstream from the cutting station for cutting the web longitudinally prior to its being cut transversely for forming multiple stacks of cut captivated sheets.

* * * * *